United States Patent [19]

Klett

[11] 3,959,901

[45] June 1, 1976

[54] HIGH STRENGTH EARTH WORKING PENETRATION TOOTH

[75] Inventor: Gene Ralph Klett, Joliet, Ill.

[73] Assignee: Caterpillar Tractor Co., Peoria, Ill.

[22] Filed: June 30, 1975

[21] Appl. No.: 591,593

[52] U.S. Cl. ..... 37/142 R; 172/699; 172/713

[51] Int. Cl.[2] ..... E02F 9/28

[58] Field of Search ..... 37/141 R, 141 T, 142 R, 37/142 A; 172/699, 713, 762

[56] References Cited

UNITED STATES PATENTS

| | | | |
|---|---|---|---|
| 2,915,290 | 12/1959 | Petersen | 37/142 R X |
| 3,002,574 | 10/1961 | Padrick | 37/142 R X |
| 3,049,824 | 8/1962 | McIninch | 37/142 X |
| 3,063,176 | 11/1962 | Larson | 37/142 R |
| 3,085,635 | 4/1963 | Livermore | 37/142 X |
| 3,191,323 | 6/1965 | Compagnon | 172/762 X |
| 3,225,467 | 12/1965 | Troeppl | 37/142 A |
| 3,349,508 | 10/1967 | Petersen | 37/142 A |
| 3,707,788 | 1/1973 | Sturgeon | 37/142 A |
| 3,805,423 | 4/1974 | Engel et al. | 37/142 X |
| 3,888,637 | 6/1975 | Taguchi et al. | 37/142 R X |

FOREIGN PATENTS OR APPLICATIONS

| | | | |
|---|---|---|---|
| 213,291 | 11/1956 | Australia | 37/142 A |
| 2,052,149 | 11/1971 | Germany | 37/142 A |

*Primary Examiner*—E. H. Eickholt
*Attorney, Agent, or Firm*—Phillips, Moore, Weissenberger Lempio & Strabala

[57] ABSTRACT

The invention is concerned with a unitary high strength earth working tooth useful with excavator buckets, scrapers, rippers and the like. The tooth is integrally formed and includes a proximal end for attachment to an earth working machine and a distal end for penetrating soil. The proximal end includes a generally isosceles trapezoidal upper portion, a generally isosceles trapezoidal lower portion, and a pair of generally isosceles trapezoidal sides, each side extending from an edge of said upper portion to an edge to said lower portion, a closure interconnecting the shorter bases of said upper portion, said lower portion and said two sides, and a pair of aligned holes, one through each of said sides generally on the bisecting axis thereof. The distal end includes a generally flat isosceles trapezoidal member extending at an obtuse angle from said lower portion with the larger base of said member coextensive with the shorter base of said lower portion, said member extending generally parallel to a plane defined by the bisecting axes of said sides. The tooth, when viewed from the side, includes a generally right triangularly shaped ridge upraised perpendicularly from the bisecting axis of said trapezoidal member and terminating at an acute angle short of the shorter base thereof, which shorter base comprises a soil penetrating portion of said distal end, the hypotenuse of said ridge extending from said acute angle towards and terminating at a point adjacent said closure, said ridge supportedly extending from said closure.

6 Claims, 4 Drawing Figures

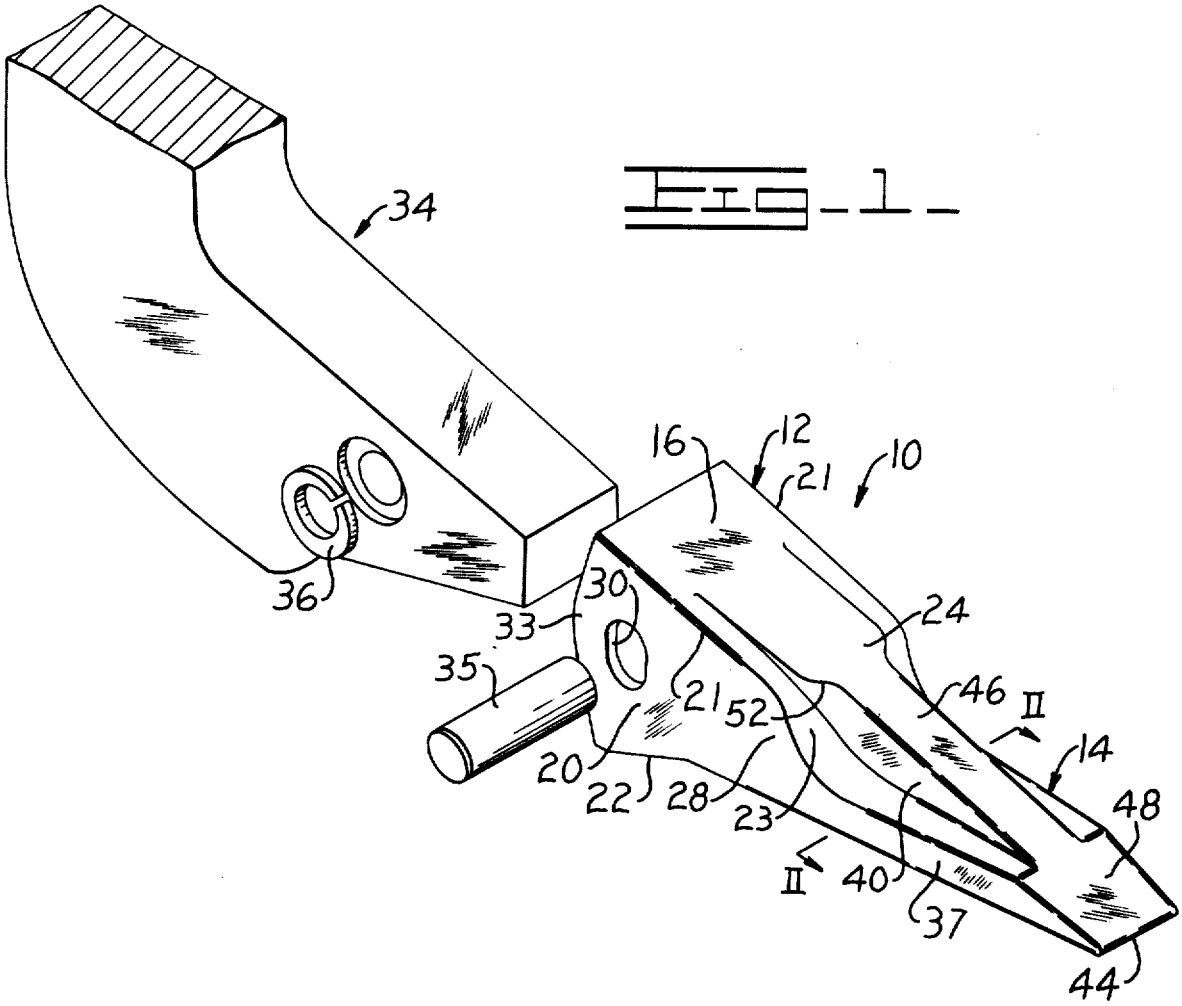
Fig-1-
Fig-2-
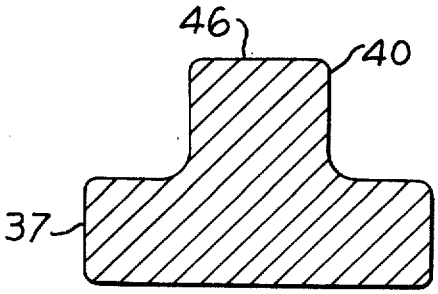

HIGH STRENGTH EARTH WORKING PENETRATION TOOTH

BACKGROUND OF THE INVENTION

1. Field of the Invention

The invention is concerned with single piece unitary high strength earth working teeth. More particularly it is concerned with such teeth as are useful for penetrating soil and the like. Teeth of this nature are used in a number of earth working machines such as for example scrapers, rippers, excavator buckets, rock buckets and the like. Still more particularly the invention is concerned with teeth which are commonly referred to in the trade as "self-sharpening". Such teeth do not really sharpen themselves as they are used but instead retain a substantially constant or slowly increasing cross section as they wear away so that they are still sharp enough to be useful even after considerable metal has been removed from them during the usual rough usage to which they are subjected.

2. Prior Art

A number of self sharpening teeth are known for use with earth working equipment. Such prior art teeth generally include a proximal end for attachment to an earth working machine and a distal end for penetrating soil. The distal end generally includes, in the prior art teeth, a generally flat trapezoidal member extending from the proximal end of the tooth to form a penetrating portion of the distal end of the tooth. In order to maintain sufficient strength for the tooth, it is customary in such a prior art tooth to provide a pair of ridges one on either side of the generally trapezoidal member, each of the ridges communicating from adjacent the soil penetrating portion of the distal end of the tooth to the proximal end of the tooth. This provides an overall cross section for the ridge containing portion of the distal end of the tooth which comprises the cross section of the trapezoidal member with the cross section of one of the ridges thereatop and the other of the ridges therebelow thus forming a crosslike cross section. The two ridges in such a prior art tooth generally extend at a straight angle or very nearly a straight angle from the proximal end of the tooth. Thus, the trapezoidal member in such teeth can be bisected by a plane passing through the trapezoidal member and through the proximal end of the tooth, said plane being perpendicular to a plane defined by said pair of ridges. Because of the symmetrical nature of such teeth, they do not provide a high penetration angle for the soil penetrating end thereof.

Teeth which are self sharpening and which also allow for the provision of a relatively high penetration angle are also commercially available. For example, H & L Tooth Company of Montebello, California produces a number of commonly designed teeth of this nature. Such teeth generally include a proximal end and a distal end as do the above discussed teeth. The distal end of such teeth, however, generally leave the proximal end thereof at an obtuse angle rather than at approximately a straight angle adjacent a lower portion of the proximal end. Adjacent the upper portion of the proximal end, the distal ends of such teeth generally proceed at substantially a straight angle. Strengthening for such teeth is generally provided by a ridge which is upraised to a point adjacent the earth penetrating end of the distal end of the tooth. The ridge then proceeds towards the proximal end of the tooth and eventually merges therewith. The ridge which supplies rigidity for such teeth is not supported by and does not end adjacent the joining of the proximal end of the tooth with the distal end of the tooth but instead continues well on to an upper portion of the proximal end of the tooth.

An improved unitary high strength earth working tooth which would be self sharpening and which would be highly penetrating while at the same time providing added strength over the existing prior art teeth would be highly desirable. The present invention provides just such an improved tooth.

SUMMARY OF THE INVENTION

The invention comprises a unitary high strength earth working tooth comprising, integrally formed, a proximal end for attachment to an earth working machine and a distal end for penetrating soil. The proximal end includes a generally isosceles trapezoidal upper portion, a generally isosceles trapezoidal lower portion, and a pair of generally isosceles trapezoidal sides, each side extending from an edge of said upper portion to an edge of said lower portion, a closure interconnecting the shorter bases of said upper portion, said lower portion and said two sides, and a pair of aligned holes, one through each of said sides generally on the bisecting axis thereof. The distal end includes a generally flat isosceles trapezoidal member extending at an obtuse angle from said lower portion with the longer base of said member coextensive with the shorter base of said lower portion, said member extending generally parallel to a plane defined by the bisecting axes of said sides. The tooth includes a generally right triangularly shaped ridge upraised perpendicularly from the bisecting axis of said trapezoidal member and terminating at an acute angle short of the shorter base thereof, which shorter base comprises a soil penetrating portion of said distal end, the hypotenuse of said ridge extending from said acute angle towards and terminating at a point adjacent said closure, said ridge supportedly extending from said closure.

BRIEF DESCRIPTION OF THE DRAWINGS

The invention will be better understood by reference to the drawings wherein like numbers denote like parts throughout and wherein:

FIG. 1 illustrates in exploded perspective a tooth of the present invention as it attaches to a shank communicating with an earth working machine;

FIG. 2 illustrates in cross section a view taken from the plane II — II of FIG. 1;

DETAILED DESCRIPTION OF THE PREFERRED EMBODIMENT

Figure 3:
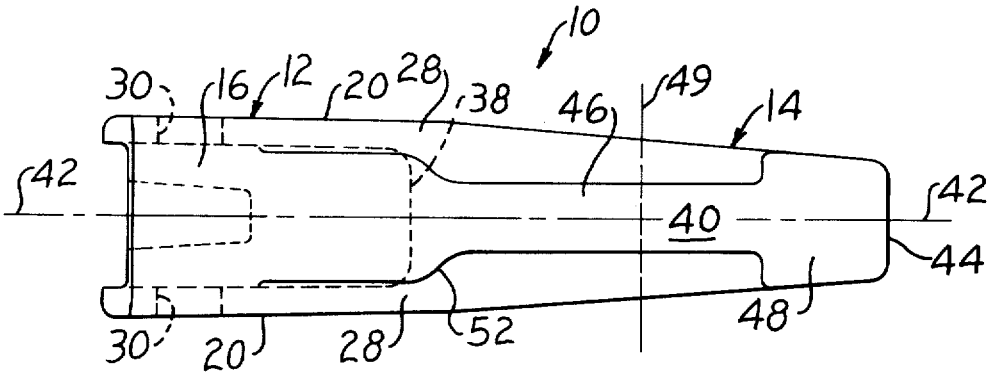
FIG. 3 illustrates in top view the tooth of the present invention.
Figure 4:
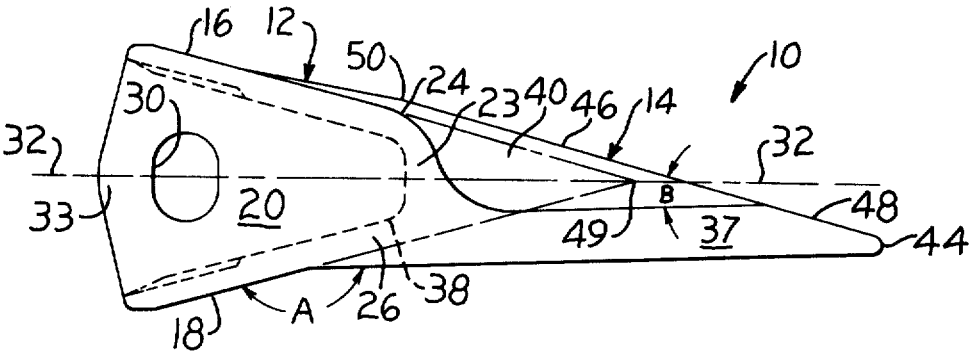
FIG. 4 illustrates in side elevation the tooth of the present invention.

The improved unitary high strength earth working tooth of the present invention is indicated generally by the numeral 10. The tooth 10 includes a proximal end 12 and a distal end 14. The tooth 10 is of unitary construction and is generally integrally formed as for example by being forged in a single piece. The proximal end 12 includes a generally isosceles trapezoidal upper portion 16 (which may be rectangular in shape) a generally isosceles trapezoidal lower portion 18 and a pair of generally isosceles trapezoidal sides 20. Each of the trapezoidal portions 16 and 18 and the trapezoidal sides 20 includes a longer base and a shorter base parallel to one another and a pair of equal edges. In the limit of rectangular shape, the two bases are equal. Each of the sides 20 extend from an edge 21 of the upper portion 16 to an edge 22 of the lower portion 18 of the proximal end 12. A closure 23 interconnects the shorter base 24 of the upper portion 16 with the shorter base 26 of the lower portion 18 and the shorter bases 28 of the pair of sides 20. The closure 23, as will be explained below, serves a very important supportive purpose. A pair of aligned holes 30 pass through each of the sides 20 generally on the bisecting axis 32 of the sides 20. The generally isosceles trapezoidal sides 20 usually include a triangular portion 33 extending therefrom in a direction removed from the distal end 14 of the tooth 10. The triangular portion 33 aids in alignment and mating of the tooth 10 with a shank 34 of an earth working machine through use of a pin 35 and one or more lock rings 36.

The distal end 14 of the tooth includes a generally isosceles trapezoidal member 37 extending at an obtuse angle, A, from the lower portion 18 of the proximal end 12 with the longer base 38 of the member 37 being coextensive with the shorter base 26 of the lower portion 18 of the proximal end 12. The member 37 extends generally parallel to a plane defined by the bisecting axes 32 of the sides 20 for strength. The tooth 10 includes a generally right triangularly shaped ridge 40 upraised perpendicularly from a bisecting axis 42 of the member 37, the ridge 40 terminating at an acute angle, B, short of the shorter base 44 of the member 37. The shorter base 44 of the member 37 comprises a soil penetrating portion of the distal end 14. A hypotenuse 46 of the ridge 40 extends from the acute angle, B, towards and terminating at a point adjacent the closure 23 of the proximal end 12. The ridge 40 supportedly extends from the closure 23. Thus, forces exerted upon the ridge 40 are generally equally distributed to the upper portion 16, the lower portion 18 and the pair of sides 20 of the proximal end 12. This provides great strength and structural integrity to the tooth 10.

The distal end 14 of the tooth 10 will generally include a ramp 48 extending from the position of the acute angle, B, to the shorter base 44 of the trapezoidal member 37. The ramp 48 is generally coplanar with the hypotenuse 46 thus providing a relatively sharp penetrating edge for easy penetration of soil and the like. The ramp 48 generally ends bluntly at the shorter base 44 of the flat trapezoidal member 37.

To assure the high strength and structural integrity of the earth working tooth 10 of the present invention, said tooth is so designed whereby an extension coplanar with the outer surface of the upper portion 16 and another extension coplanar with the outer surface of the lower portion 18 of the proximal end 12 meet in a line 49 which is intermediate said shorter base 44 of the trapezoidal member 37 and a termination point 50 of the hypotenuse 46. Thus, the effective lever arm of the shorter base 44 of the member 37 acting upon the proximal end 12 of the tooth 10 is nearly within the triangulation provided by the upper portion 16 and the lower portion 18 of the proximal end 12. Preferably, the line 49 of meeting is nearer to the shorter base 44 of the trapezoidal member 37 than to the termination point 50 of the hypotenuse. This assures that the effective lever arm of dirt acting upon the shorter base 44 of the flat member 37 is braced as effectively as possible by the upper portion 16 and the lower portion 18 of the proximal end 12.

To assure relatively easy and effective penetration of the tooth 10, even after considerably wear (to make the tooth 10 "self sharpening") the ridge 40 is generally rectangular in cross section and is generally no more than about two thirds in width of the width of the shorter base 44 of the trapezoidal member 37 and usually is about one half in width of the shorter base 44.

In a preferred embodiment of the invention as illustrated, the ridge 40 extends for yet added strength supportedly from the closure 23 via a curved reinforcing brace 52 having a width at least about as wide as the width of the shorter base 44 of the trapezoidal member 37.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A unitary high strength earth working tooth, comprising, integrally formed, a proximal end for attachment to an earth working machine and a distal end for penetrating soil:

said proximal end including a generally isosceles trapezoidal upper portion, a generally isosceles trapezoidal lower portion, and a pair of generally isosceles trapezoidal sides, each side extending from an edge of said upper portion to an edge of said lower portion, a closure interconnecting the shorter bases of said upper portion, said lower portion and said two sides, and a pair of aligned holes, one through each of said sides generally on the bisecting axis thereof;

said distal end including a generally flat isosceles trapezoidal member extending at an obtuse angle from said lower portion with the longer base of said member coextensive with the shorter base of said lower portion, said member extending generally parallel to a plane defined by the bisecting axis of said sides;

said tooth including a generally right triangularly shaped ridge upraised perpendicularly from the bisecting axis of said trapezoidal member and terminating at an acute angle short of the shorter base thereof, which shorter base comprises a soil penetrating portion of said distal end, the hypotenuse of said ridge extending from said acute angle towards and terminating at a point adjacent said closure, said ridge supportedly extending from said closure.

2. A tooth as in claim 1, including a ramp extending from said acute angle to the shorter base of said trapezoidal member, said ramp being coplanar with said hypotenuse.

3. A tooth as in claim 2, wherein an extension of the outer surface of said upper portion and an extension of the outer surface of said lower portion meet in a line which is intermediate said shorter base of said trapezoidal member and said termination point of said hypotenuse.

4. A tooth as in claim 3, wherein said line is nearer to said shorter base of said trapezoidal than to said termination point of said hypotenuse.

5. A tooth as in claim 4, wherein said ridge is generally rectangular in cross section and is no more than about two thirds in width of the width of the shorter base of said trapezoidal member.

6. A tooth as in claim 5, wherein said ridge extends supportedly from said closure via a curved reinforcing brace having a width at least about as wide as the width of the top of said trapezoidal member.

* * * * *